US008746822B2

(12) United States Patent
Yasuzaki et al.

(10) Patent No.: US 8,746,822 B2
(45) Date of Patent: Jun. 10, 2014

(54) PRINT CONTROL APPARATUS, PRINT CONTROL METHOD, AND RECORDING MEDIUM

(71) Applicant: Canon Kabushiki Kaisha, Tokyo (JP)

(72) Inventors: Koji Yasuzaki, Tokorozawa (JP); Kazunari Shishido, Yokohama (JP); Sho Nakamura, Yokohama (JP); Ruriko Mikami, Kawasaki (JP); Atsushi Hirahara, Kawasaki (JP); Takayoshi Noguchi, Tokyo (JP); Akiteru Naka, Machida (JP); Tatsuhiko Tomita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 13/656,197

(22) Filed: Oct. 19, 2012

(65) Prior Publication Data

US 2013/0100187 A1 Apr. 25, 2013

(30) Foreign Application Priority Data

Oct. 21, 2011 (JP) ..... 2011-232047

(51) Int. Cl.
*B41J 29/38* (2006.01)
*B41J 2/165* (2006.01)

(52) U.S. Cl.
USPC ..... 347/5; 347/22

(58) Field of Classification Search
USPC ..... 347/5, 9, 11, 14, 20, 22, 23
See application file for complete search history.

(56) References Cited

U.S. PATENT DOCUMENTS 5,469,183 A * 11/1995 Takatsuji et al. ..... 345/2.2
8,007,064 B2 * 8/2011 Tsuchiya ..... 347/7
8,403,441 B2 * 3/2013 Tsubota et al. ..... 347/11

FOREIGN PATENT DOCUMENTS

JP 2005-131809 A 5/2005

* cited by examiner

*Primary Examiner* — Anh T. N. Vo
(74) *Attorney, Agent, or Firm* — Canon USA Inc. IP Division

(57) ABSTRACT

A print control apparatus configured to cause a printing unit to perform print processing includes a determination unit configured to determine whether a condition for executing maintenance processing of the printing unit is satisfied, a shortening unit configured to shorten redundant maintenance operations in first maintenance processing and second maintenance processing in a case where the determination unit determines that a condition for executing the second maintenance processing is satisfied before completion of the first maintenance processing, and a control unit configured to cause the first maintenance processing and the second maintenance processing to be carried out after the shortening unit shortens the redundant maintenance operations.

20 Claims, 7 Drawing Sheets

PRINT CONTROL APPARATUS, PRINT CONTROL METHOD, AND RECORDING MEDIUM

BACKGROUND OF THE INVENTION

1. Field of the Invention

The claimed invention generally relates to printing and, more particularly, to a print control apparatus, a print control method, and a recording medium storing a program capable of performing maintenance processing when a predetermined condition is satisfied.

2. Description of the Related Art

Conventionally, as one example of printing apparatuses that print images with use of recording agents such as ink and toner, there has been known a printing apparatus configured to carry out maintenance processing such as calibration processing, as discussed in Japanese Patent Application Laid-Open No. 2005-131809. Further, such maintenance processing is carried out according to satisfaction of various kinds of conditions such as an elapse of a predetermined time, printing of a predetermined number of sheets, and discharges of a predetermined number of dots.

However, in a case where the various kinds of conditions that trigger execution of the maintenance processing are satisfied one after another at close timing, this results in repeated execution of the maintenance processing of the same content in a short period. In this case, there occur problems such as keeping a normal print job waiting for a long time during execution of the maintenance processing, and unnecessary execution of the maintenance.

SUMMARY OF THE INVENTION

The claimed invention is directed to a print control apparatus, a print control method, and a recording medium storing a program capable of effectively carrying out maintenance processing.

According to an aspect of the claimed invention, a print control apparatus configured to cause a printing unit to perform print processing includes a determination unit configured to determine whether a condition for executing maintenance processing of the printing unit is satisfied, a shortening unit configured to shorten redundant maintenance operations in first maintenance processing and second maintenance processing in a case where the determination unit determines that a condition for executing the second maintenance processing is satisfied before completion of the first maintenance processing, and a control unit configured to cause the first maintenance processing and the second maintenance processing to be carried out after the shortening unit shortens the redundant maintenance operations.

Further features and aspects of the claimed invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the claimed invention and, together with the description, serve to explain the principles of the claimed invention.

DESCRIPTION OF THE EMBODIMENTS

Various exemplary embodiments, features, and aspects of the claimed invention will be described in detail below with reference to the drawings.

Hereinafter, an exemplary embodiment of the claimed invention will be described with reference to the drawings. The relative positions, shapes, and other features of the respective components in an apparatus used in this exemplary embodiment are mere an example, and the claimed invention is not limited thereto.

Figure 1:
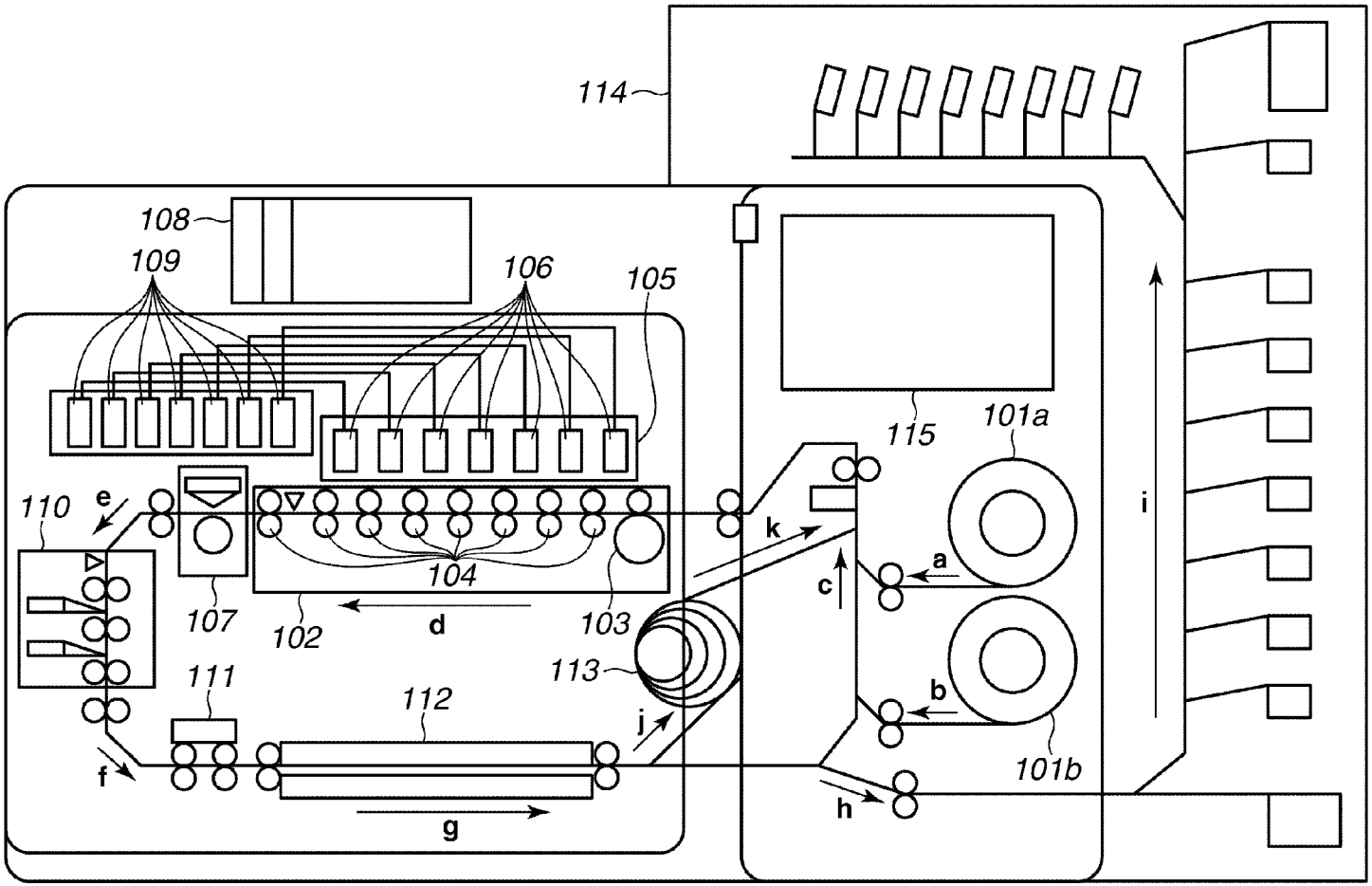
FIG. 1 illustrates a configuration of an image forming apparatus according to an exemplary embodiment of the claimed invention.

FIG. 1 is an overview diagram illustrating a configuration of an image forming apparatus, which is an example of a print control apparatus according to the present exemplary embodiment. The image forming apparatus illustrated in FIG. 1 will be described as an apparatus having only the print function of printing data received from an external apparatus. However, the image forming apparatus according to the present exemplary embodiment is not limited thereto, and may be embodied by an apparatus further including a reading device configured to read an image on a document to function as a copying machine, or a multifunction peripheral having other functions.

Further, the present exemplary embodiment will be described based on an example using a roll sheet as a recording material (a medium to be recorded or a recording sheet) to which print processing is performed. This roll sheet is an example of a continuous sheet, and does not have to be in a rolled state and may be embodied by any long continuous sheet capable of continuously receiving a print operation corresponding to a plurality of pages on a same surface without breaking the print operation in the middle thereof.

Further, the continuous sheet may be automatically cut by the image forming apparatus or may be cut according to an instruction issued by a user manually. The recording material does not have to be made of paper, and may be made of any of various kinds of materials capable of being printed. Further, the image forming apparatus may be an image forming apparatus capable of performing print processing on not only a continuous sheet but also a cut sheet separated into a predetermined size in advance.

Further, as the printing method, the image forming apparatus does not necessarily have to print an image by the inkjet printing method using image printing liquid ink, which will be described below. The image forming apparatus may use solid ink as a recording agent to be applied onto a recording material, or may employ any of various kinds of printing methods such as the electrophotographic method using toner, the sublimation method, the thermal transfer method, the dot impact method, etc.

Further, the image forming apparatus is not limited to an image forming apparatus that performs color recording by using recording agents of a plurality of colors, and may be an image forming apparatus that performs monochrome recording by using only a black recording agent (including a gray recording agent). Further, a printed object is not limited to a visible image, and may be an invisible or hardly visible image. Further, a printed object is not limited to an ordinary image, and may be any of various kinds of objects such as a wiring pattern, a physical pattern in manufacturing of parts, a base sequence of deoxyribonucleic acid (DNA), etc.

In other words, the present exemplary embodiment can be applied to various types of recording apparatuses capable of providing a recording agent onto a recording material. Further, in a case where an operation of print processing of the image forming apparatus is controlled by an instruction from an external apparatus connected to the image forming apparatus illustrated in FIG. 1, this external apparatus corresponds to the print control apparatus.

FIG. 1 is a cross-sectional view illustrating an overview of the entire configuration of the image forming apparatus using a roll sheet (a continuous sheet longer than the length of a print unit (a page) in a conveyance direction) as a recording material. The image forming apparatus includes components 101 to 115 that will be described below, and these components 101 to 115 are contained in a single housing. Alternatively, these components may be separately contained in a plurality of housings.

A control unit 108 includes a controller (including a central processing unit (CPU), a micro processing unit (MPU), and/or the like), an output unit for outputting user interface information (a generator for generating, for example, display information and acoustic information), and an input/output (I/O) control unit including various kinds of I/O interfaces. The control unit 108 is in charge of various kinds of control for the entire image forming apparatus.

The image forming apparatus includes two sheet cassettes, an upper sheet cassette 101*a* and a lower sheet cassette 101*b* as units for holding and supplying roll sheets. A user loads a roll sheet (hereinafter referred to as a "sheet") on a magazine, and then mounts it on the main body of the image forming apparatus. The sheet pulled out from the upper sheet cassette 101*a* is conveyed in the direction indicated by the arrow "a" illustrated in FIG. 1, and the sheet pulled out from the lower sheet cassette 101*b* is conveyed in the direction indicated by the arrow "b" illustrated in FIG. 1.

The sheet supplied from any of the upper and lower sheet cassettes 101*a* and 101*b* is transferred in the direction indicated by the arrow "c" in FIG. 1, and reaches a conveyance unit 102. The conveyance unit 102 conveys the sheet in the direction (the horizontal direction) indicated by the arrow "d" in FIG. 1 via a plurality of rotation rollers 104 during print processing. The sheet cassette as a supply source can be switched from one cassette to the other cassette by winding back an already unwound sheet into the cassette, and then newly supplying a sheet from the cassette having the sheet to be newly supplied.

A head unit 105 is disposed facing to the conveyance unit 102 above the conveyance unit 102. The head unit 105 holds independent print heads 106 of a plurality of colors (seven colors in the present exemplary embodiment) along the sheet conveyance direction. In the present exemplary embodiment, the head unit 105 includes seven print heads 106 corresponding to seven colors, cyan (C), magenta (M), yellow (Y), light cyan (LC), light magenta (LC), gray (G), and black (K). Alternatively, the image forming apparatus may use another color different from these colors, or does not necessarily have to use all of them.

The present image forming apparatus causes the print heads 106 to discharge ink in synchronization with sheet conveyance by the conveyance unit 102, thereby forming an image on the sheet. The print heads 106 are located at such positions that discharge destinations of inks are out of alignment with the rotation rollers 4. Instead of being directly discharged on a sheet, ink may be provided on an intermediate transfer member and then be provided to a sheet, thereby forming an image thereon.

The printing unit according to the present exemplary embodiment is constituted by including the conveyance unit 102, the head unit 105, and the print heads 106.

Ink tanks 109 independently store ink of the respective colors. The ink is supplied from the ink tanks 109 to sub tanks disposed corresponding to the respective colors via tubes, and is supplied from the sub tanks to the respective print heads 106 via tubes. The print heads 106 are disposed in such a manner that the line heads of the respective colors (seven colors in the present exemplary embodiment) are arranged along the direction indicated by the arrow "d", which is the conveyance direction at the time of printing.

Each of the line heads of the respective colors may be formed by a single continuous nozzle chip or may be formed by divided nozzle chips arranged in a single line or in a regular pattern such as a staggered arrangement. In the present exemplary embodiment, each of the line heads is configured as a so-called full multi-head including nozzles arranged in a range covering the width of a print region of a sheet having a maximum size usable by the present image forming apparatus.

Employable methods as the inkjet method, according to which ink is discharged from nozzles, include, for example, the method using heating elements, the method using piezoelectric elements, the method using electrostatic elements, the method using microelectromechanical system (MEMS) elements, etc. The ink is discharged from the nozzles of the respective heads based on print data, and the discharge timing is determined by an output signal from a conveyance encoder 103.

Further, the width of each of the print heads 106 is longer than the width of a sheet usable by the present image forming apparatus, and therefore discharges from all nozzles are not performed by one recording operation. Therefore, during maintenance of the print head 106, which is carried out by discharging ink onto a sheet, ink is discharged from all of the nozzles while the print head 106 is moved in a direction perpendicular to the sheet conveyance direction (Y movement). In other words, during a first discharge process, ink is discharged from a part of the nozzles, among all nozzles of the print head 106, onto a sheet. Then, during a second discharge process, the print head 106 is driven to have a Y movement, and ink is discharged from the remaining nozzles onto a sheet.

Further, examples of operations for maintenance of the print head 106 include various kinds of operations such as a process for sucking ink from the print head 106 and wiping the discharge surface of the print head 106 (wiping process), a process for correcting a nozzle failing to appropriately discharge ink, a process for correcting uneven ink discharges, a process for correcting an ink discharge amount, a preliminary discharge process, etc.

The maintenance processing includes one or more maintenance operations, and is carried out, for example, every time a predetermined time has elapsed, every time a waiting time has reached a predetermined time, every time a predetermined number of pages are printed, and every time a dot count (the number of ink discharge dots) has reached a predetermined number. Further, a different kind of maintenance processing may be carried out for each of these conditions.

After an image is formed on a sheet, the sheet is conveyed from the conveyance unit 102 to a scanner unit 107. The scanner unit 107, for example, optically reads a printed image or a special pattern on the sheet to check whether there is no problem with the printed image, and to check the state of the present image forming apparatus including the ink discharge state.

The method for checking the printed image may include reading a pattern prepared for checking the state of the print head 106 to thereby check the ink discharge state, or may include comparing the printed image with the original image to check whether the image is successfully printed. The method for checking the printed image can be arbitrarily selected from various kinds of methods.

The sheet is conveyed from the vicinity of the scanner unit 107 in the direction indicated by the arrow "e", and is introduced into a cutter unit 110. The cutter unit 110 cuts the sheet by every length corresponding to a predetermined print unit. This length corresponding to the predetermined print unit varies depending on the size of an image to be printed. For example, an L-size photograph is 135 mm long in the conveyance direction, and an A4-size image is 297 mm long in the conveyance direction.

At the time of one-sided printing, the cutter unit 110 cuts the sheet by every page, but in some cases, the cutter unit 110 does not cut the sheet by every page depending on the content of a print job. On the other hand, at the time of two-sided printing, the image forming apparatus 200 continuously prints an image corresponding to a predetermined length without cutting the sheet by every page when processing a first surface (a surface printed first, for example, the front surface) of the sheet, and the cutter unit 110 cuts the sheet by every page when processing a second surface (a surface printed later; for example, the back surface).

The cutter unit 110 does not necessarily have to cut the sheet by every image when performing one-sided printing or processing the back surface at the time of two-sided printing. The cutter unit 110 may refrain from cutting the sheet until the sheet is conveyed by a predetermined length and then cut the sheet after the sheet is conveyed by the predetermined length, and the sheet may be separated into pieces, each of which corresponds to one sheet (page) of image, by another cutter device according to, for example, a manual operation. Further, another cutter device is used to cut the sheet in the sheet width direction, if necessary.

The sheet conveyed from the cutter unit 110 is conveyed within the unit in the direction indicated by the arrow "f" illustrated in FIG. 1, and is transferred to a back surface printing unit 111. The back surface printing unit 111 is a unit for printing predetermined information on the back surface of the sheet, in a case where an image is printed only on one surface of the sheet.

The information printed on the back surface of the sheet includes information such as a character, a mark, and a code corresponding to each printed image (for example, a number for order management). In a case where the print heads 106 print an image for a print job of two-sided printing, the back surface printing unit 111 prints the above-described information at a location other than a region where the print heads 106 print the image. The back surface printing unit 111 may print the information by, for example, stamping a recording agent, employing the heat transfer method, or employing the inkjet method.

The sheet transmitted through the back surface printing unit 111 is then conveyed to a drying unit 112. The drying unit 112 is a unit for heating the sheet transmitted within the unit in the direction indicated by the arrow "g" illustrated in FIG. 1 by hot wind (heated gas (air)) to dry the sheet with ink provided thereon in a short time.

Instead of using hot wind, the drying unit 112 may dry the sheet by any of various kinds of drying methods, such as using cold wind, heating the sheet by a heater, only keeping the sheet waiting for natural drying, and irradiating the sheet with electromagnetic waves such as ultraviolet light. After the sheet is cut into pages having the length corresponding to the print unit, the pages are transmitted through the drying unit 112 one by one, are conveyed in the direction indicated by the arrow "h" illustrated in FIG. 1, and are transferred to a sorting unit 114.

The sorting unit 114 holds a plurality of trays (18 trays in the present exemplary embodiment), and determines which tray the sheet should be discharged to according to, for example, the length of the print unit. Tray numbers are assigned to the respective trays. The sorting unit 114 discharges the sheet transmitted within the unit in the direction indicated by the arrow "i" illustrated in FIG. 1 to the tray corresponding to the tray number set for each printed image, while checking, for example, whether there is some space left on the tray or the tray is full of sheets using a sensor disposed on each tray.

As a tray to which the cut sheet is discharged, a specific tray may be specified by a source (host apparatus) that has issued the print job, or an available tray may be arbitrarily specified by the image forming apparatus. Sheets can be discharged onto one tray up to a predetermined number of sheets. For a print job exceeding the predetermined number of sheets, the sheets are discharged across a plurality of trays.

For example, the number of sheets, the size of sheets, and the type of sheets dischargeable to a tray vary depending on, for example, the size (type) of the tray. The vertically aligned trays (the trays aligned in the up-down direction) (hereinafter referred to as "large trays") illustrated in FIG. 1 can receive discharges of large-sized sheets (sheets larger than L-size sheets, such as A4-size sheets), and small-sized sheets (L-size sheets).

On the other hand, the horizontally aligned trays (the trays aligned in the left-to-right direction) (hereinafter referred to as "small trays") can receive discharges of small-sized sheets (L-size sheets) but cannot receive discharges of large-sized sheets. The large trays can receive a larger number of discharged sheets than the small trays.

Further, the image forming apparatus is configured to allow a user to recognize, for example, a state that sheets are currently being discharged and a state that discharges of sheets have been completed with use of an indicator (for example, using a light-emitting diode (LED)). For example, the respective trays may be provided with a plurality of LEDs that emit light beams of colors different from one another, and various kinds of states of each tray can be notified to a user based on, for example, the color of the LED emitting light, or based on whether the LED is turned on or the LED is flashing.

Further, a priority ranking can be assigned to each of the plurality of trays. In this case, the image forming apparatus 200 determines an empty tray (a tray on which no sheet is discharged) as a sheet discharge destination according to the priority ranking in order, when carrying out a print job.

The priority ranking is determined for the large trays by default in such a manner that the priority increases as the position of the tray is getting closer to the top. On the other hand, the priority ranking is determined for the small trays by default in such a manner that the priority increases as the position of the tray is getting closer to the left end. Further, a higher priority is placed on the small trays than the large trays. This priority ranking may be set in advance in such a manner that a higher priority is placed on a tray from which an output sheet can be easily taken out by a user. Further, the image forming apparatus may be configured in such a manner that the priority ranking can be arbitrarily changed by, for example, a user's operation.

A sheet take-up unit 113 takes up the sheet that has data printed on the front surface thereof without being cut by every page. At the time of two-sided printing, the cutter unit 110 does not cut the sheet with an image formed on the front surface thereof by every page at first. Then, the cutter unit 110 cuts the sheet after completion of printing of the continuous front surface.

The sheet with the image printed on the front surface thereof is conveyed within the unit in the direction indicated by the arrow "j" illustrated in FIG. 1, and the sheet take-up unit 113 takes up the sheet. Then, after completion of image formation on the front surface corresponding to a series of pages, the wound sheet is conveyed again within the unit in the direction indicated by the arrow "k" illustrated in FIG. 1, after the sheet is set in such a manner that an image can be printed on the opposite surface from the previously processed front surface, i.e., the surface supposed to face the print heads 106 is turned over.

Conveying the sheet in this manner allows an image to be printed on the back surface opposite to the previously processed front surface. At the time of normal one-sided printing, the sheet with an image printed thereon is conveyed to the sorting unit 114 without being taken up by the sheet take-up unit 113.

In this way, at the time of two-sided printing of a sheet, the sheet is taken up by using the sheet take-up unit 113, then, the sheet is turned over to be printed on the back surface of the sheet. Therefore, the sheet is discharged to the sorting unit 114 with different surfaces facing upward between a discharge after an image is printed only on one surface of the sheet and a discharge after an image is printed on both surfaces of the sheet. In other words, at the time of one-sided printing, the sheet is not turned over by using the sheet take-up unit 113, whereby the sheet with the image of the first page printed thereon is discharged with the image of the first page facing downward.

Then, when a plurality of pages is printed by a single print job, the sheet of the first page is discharged onto the tray first. After that, the subsequent sheets are discharged in order, and are sequentially stacked on the tray. This discharge is called a face-down discharge.

On the other hand, at the time of two-sided printing, the sheet is turned over by using the sheet take-up unit 113, whereby the sheet with the image of the first page printed thereon is discharged with the image of the first page facing upward. Then, when a plurality of pages is output by a single print job, the sheet containing the last page is discharged onto the tray first. After that, the subsequent sheets are sequentially discharged in ascending order of the page number to be stacked one after another. Lastly, the sheet with the image of the first page printed thereon is discharged. This discharge is called a face-up discharge.

The print order of the first surface (whether sheets are printed in descending order or ascending order) may be changed between one-sided printing and two-sided printing so that the sheets are discharged with the same surfaces facing upward between a discharge at the time of one-sided printing and a discharge at the time of two-sided printing (the sheets are discharged according to a consistent discharge method, either the face-up discharge or the face-down discharge, for both one-sided printing and two-side printing).

An operation unit 115 is a unit for allowing a user to perform various kinds of operations, and notifying a user of various kinds of information. For example, a user can check a print state for each order, such as which tray a sheet with an image specified by the user printed thereon is stacked on, or whether the image is currently being printed or has been printed already. Further, a user can operate or check the operation unit 115 to check various kinds of states of the image forming apparatus such as a remaining ink amount and a remaining sheet amount, or to instruct the image forming apparatus to carry out apparatus maintenance such as head cleaning.

Figure 2:
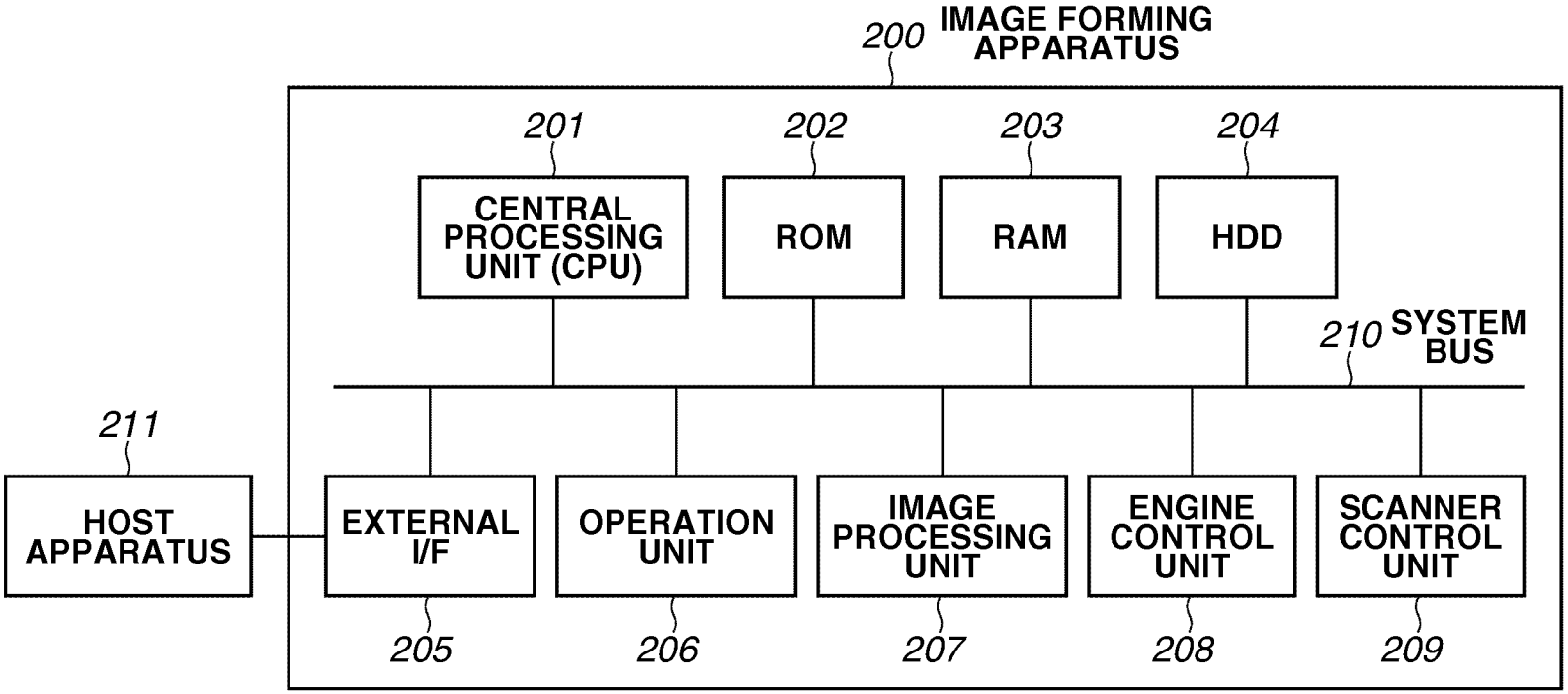
FIG. 2 is a block diagram illustrating a configuration relating to control of the image forming apparatus illustrated in FIG. 1.

FIG. 2 is a block diagram illustrating a configuration relating to the control by the image forming apparatus illustrated in FIG. 1. The image forming apparatus 200 is the image forming apparatus illustrated in FIG. 1.

The control unit 108 mainly includes a CPU 201, a read only memory (ROM) 202, a random access memory (RAM) 203, an image processing unit 207, an engine control unit 208, and a scanner control unit 209. Then, for example, a hard disk drive (HDD) 204, an operation unit 206, and an external interface (I/F) 205 are connected to the control unit 108 via a system bus 210.

The CPU 201 is a central processing unit in the form of a microprocessor (microcomputer), and is included in the control unit 108 illustrated in FIG. 1. The CPU 201 controls the operation of the entire image forming apparatus 200 by executing a program and activating hardware.

The ROM 202 stores a program to be executed by the CPU 201, and fixed data used for various kinds of operations by the image forming apparatus 200. The RAM 203 is used as a work area of the CPU 201, an area for temporarily storing various kinds of received data, and an area for storing various kinds of setting data. The HDD 204 allows a program to be executed by the CPU 201, print data, and setting information used for various kinds of operations of the image forming apparatus 200 to be stored in and read from a built-in hard disk thereof.

Further, the HDD 204 constructs a queue for managing print jobs, and subsequently registers jobs input into the image forming apparatus 200 in the queue. The HDD 204 may be replaced with another mass storage device. The CPU 201 loads the program code stored in the ROM 202 or the HDD 204 to the RAM 203 and executes it, which realizes processing flows illustrated in the flowcharts that will be described below.

The operation unit 206 includes hard keys and a touch panel allowing a user to perform various kinds of operations, and a display unit for presenting (reporting) various kinds of information to a user, and corresponds to the operation unit 115 illustrated in FIG. 1. Further, the image forming apparatus 200 can also present information to a user by outputting a sound (for example, a beep or a voice) based on acoustic information from a sound generator.

The image processing unit 207 performs development (conversion) of print data handled by the image forming apparatus 200 (for example, data expressed in the page description language) into image data (a bitmap image), and image processing. The image processing unit 207 converts a color space (for example, YCbCr) of image data included in input print data into a standard RGB color space (for example, sRGB).

Further, the image processing unit 207 performs various kinds of image processing such as resolution conversion into a valid pixel number (printable by the image forming apparatus 200), an image analysis, and an image correction on image data as necessary. The image data acquired from these kinds of image processing is stored in the RAM 203 or the HDD 204.

Further, the image processing unit 207 and the external I/F 205 may be provided with another power source separate from the main power source of the image forming apparatus 200. In this case, while the main power source is turned off, a print job can be received from a host apparatus 211, and the print job can be stored in the HDD 204 in a state already processed by a part of the image processing. Further, supplying power to the image processing unit 207 while the main power source of the image forming apparatus 200 is turned off enables even maintenance processing to be kept waiting in the HDD 204 as a job.

The engine control unit 208 controls processing for printing an image based on print data on a sheet according to a control command received from, for example, the CPU 201. The engine control unit 208 instructs the print heads 106 of the respective colors to discharge ink, sets discharge timing to adjust dot positions (ink impact positions) on a recording medium, and adjusts the print heads 106 based on acquisition of the head driving states, for example.

The engine control unit 208 controls driving of the print heads 106 according to print data, and controls the print heads 106 to discharge ink to form an image on a sheet. Further, the engine control unit 208 controls conveyance rollers such as issuing an instruction to drive pullout rollers for pulling out a sheet from a cassette, issuing an instruction to drive conveyance rollers for conveying the pulled-out sheet, to acquires the rotation states of the conveyer rollers, and to cause the sheet to be conveyed or stopped at an appropriate speed and along an appropriate route.

The scanner control unit 209 controls an image sensor according to a control command received from, for example, the CPU 201. The scanner control unit 209 reads an image on a sheet, acquires analog luminance data of red (R), green (G), and blue (B) colors, and converts the acquired data into digital data. The image sensor may be embodied by, for example, a Charge Coupled Device (CCD) image sensor or a Complementary Metal Oxide Semiconductor (CMOS) sensor. Further, the image sensor may be configured as a linear image sensor or an area image sensor.

Further, the scanner control unit 209, for example, issues an instruction to drive the image sensor, acquires the state of the image sensor based on this driving, analyzes luminance data acquired from the image sensor, and detects a failure in an ink discharge from the print head 106 and a position where a sheet is cut. When the scanner control unit 209 determines that an image is correctly printed on a sheet, this sheet is discharged onto a specified tray in the sorting unit 114 after the ink on the sheet is dried.

The host apparatus 211 corresponds to the above-described external apparatus. The host apparatus 211 is externally connected to the present image forming apparatus 200 to serve as a source for supplying image data for causing the image forming apparatus 200 to print the image data, and issues orders for various kinds of print jobs.

The host apparatus 211 may be embodied by a general-purpose personal computer (PC), or another type of data supply apparatus. Examples of another data supply apparatus include an image capture apparatus configured to capture an image to generate image data. The image capture apparatus is, for example, a reader (scanner) configured to read an image on a document to generate image data, and a film scanner configured to read a negative film or a positive film to generate image date.

Further, other examples of the image capture apparatus includes a digital camera configured to capture a still image to generate digital image data, and a digital video camera to capture a moving image to generate moving image data. As other examples of the host apparatus 211, a photo storage may be provided in a network or a socket may be provided at the image forming apparatus 200 to enable insertion of a detachable portable memory, and the image forming apparatus 200 may read an image file stored in the photo storage or the portable memory to generate image data to print it.

Further, the host apparatus 211 may be embodied by any of various kinds of data supply apparatuses such as a terminal dedicated to the image forming apparatus 200, instead of the general-purpose PC. This data supply apparatus may be configured as a constituent element of the image forming apparatus 200 or may be configured as another separate apparatus externally connected to the image forming apparatus 200.

In a case where the host apparatus 211 is embodied by a PC, an operating system (OS), application software for generating image data, and a printer driver for the image forming apparatus 200 are installed in a storage device of this PC.

The printer driver controls the image forming apparatus 200, and converts image data supplied from the application software into data in a format processable by the image forming apparatus 200 to generate print data. Further, conversion of print data into image data may be performed by the host apparatus 211, and then be supplied to the image forming apparatus 200.

All of the above-described processing do not necessarily have to be realized by means of software, and a part or all of it may be realized by means of hardware such as an Application Specific Integrated Circuit (ASIC).

For example, image data, other commands, and a status signal supplied from the host apparatus 211 can be transmitted and received to and from the image forming apparatus 200 and the host apparatus 211 via the external I/F 205. The external I/F 205 may be a local I/F or a network I/F. Further, the external I/F 205 may be wired connection or wireless connection.

The above-described units in the image forming apparatus 200 are connected to be communicable with one another via the system bus 210.

In the above-described example, the single CPU 201 controls all of the constituent elements in the image forming apparatus 200 illustrated in FIG. 2. However, the present exemplary embodiment may have another configuration. More specifically, some of the functional blocks may include additional CPUs, and may be individually controlled by the respective CPUs.

Further, the functional blocks may be configured in various manners, different from the distribution of the respective blocks illustrated in FIG. 2, by appropriately dividing the blocks into individual processing units or control units, or integrating several blocks. Further, a Direct Memory Access Controller (DMAC) can be used to read data from the memory.

Figure 3:
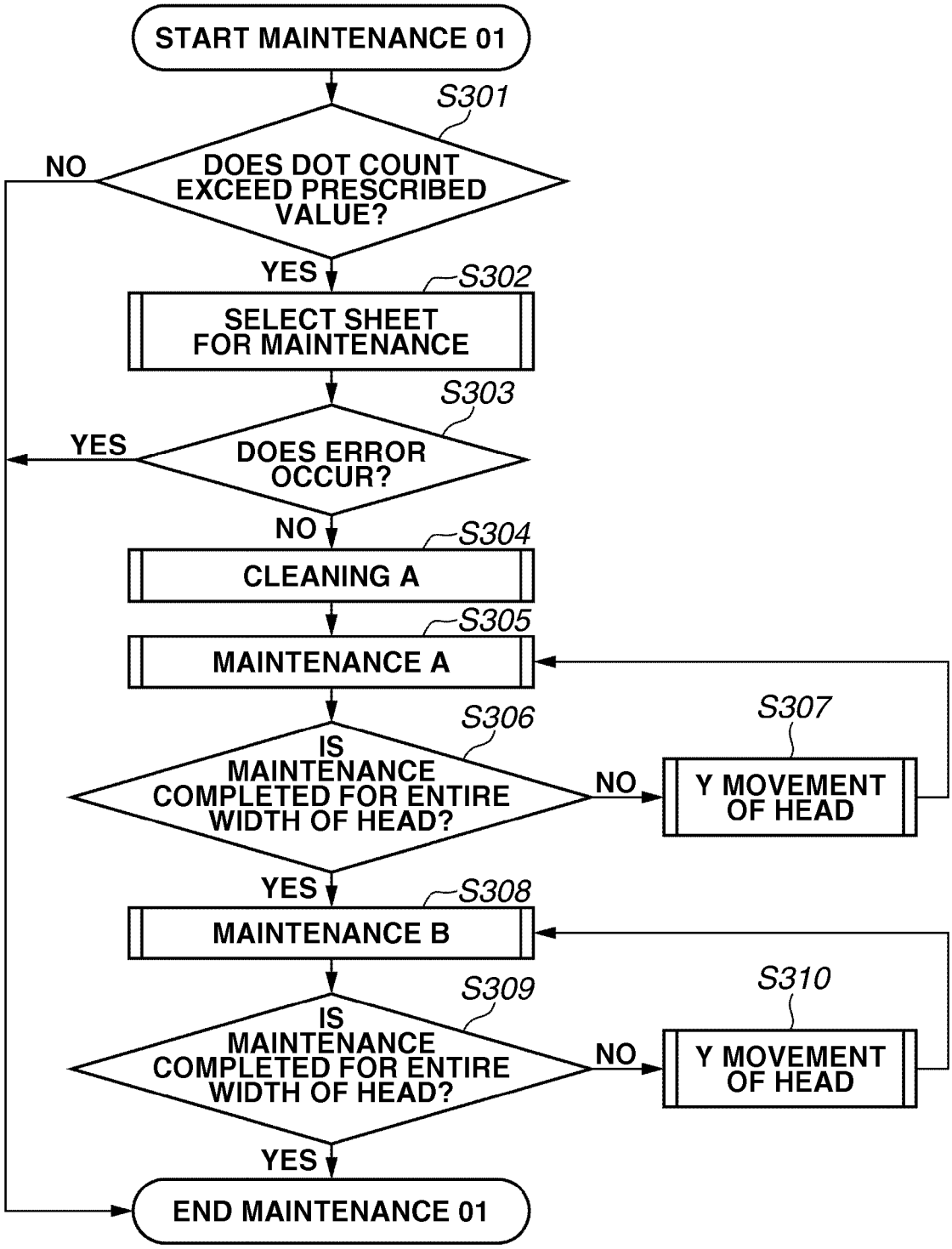
FIG. 3 is a flowchart illustrating a processing flow when maintenance 01 is carried out alone.

Next, the maintenance processing by the image forming apparatus 200 will be described. FIG. 3 is a flowchart illustrating a processing flow of maintenance 01 performed when the number of dots discharged by the print head 106 (dot count) exceeds a prescribed value.

During the maintenance 01, cleaning A, maintenance A, and maintenance B are carried out in order. The cleaning A includes sucking ink from all nozzles of the print head 106, and then wiping the discharge surface of the print head 106.

The maintenance A includes printing a predetermined pattern for the maintenance A on a sheet with use of the print head 106, reading the image by the scanner unit 107, detecting a discharge failure in the print head 106, and correcting the failure.

The maintenance B includes printing a predetermined pattern for the maintenance B on a sheet with use of the print head 106, reading the image by the scanner unit 107, and then correcting uneven ink discharge states among the respective nozzles of the print head 106. The CPU 201 increments the dot count value each time the print head 106 discharges ink, and starts the maintenance 01 upon determination that the dot count value exceeds the prescribed value.

The dot count value is stored in the RAM 203, and the prescribed value is a predetermined value. Further, the CPU 201 manages the maintenance 01 as a job, and handles the maintenance 01 in a similar manner to handling a normal print job (a print job input from the host apparatus 211).

In step S301, the CPU 201 checks whether the dot count value of the print head 106 exceeds the prescribed value, which involves execution of a job of the maintenance 01. If the CPU 201 determines that the dot count value exceeds the prescribed value (YES in step S301), the CPU 201 generates a job of the maintenance 01 by the image processing unit 205.

As a result, the job of the maintenance 01 is registered in the same queue as the queue for a normal print job. However, the order of the queue is changed so as to carry out the job of the maintenance 01 before a print job that is not started yet, thereby allowing the maintenance processing to be started as soon as possible. In other words, the job of the maintenance processing is registered at the head of waiting print jobs.

However, in a case where another maintenance processing job is already registered in the queue, the present maintenance job is registered after this job.

When it is time to carry out the maintenance 01 registered in the queue according to the order of the queue, in step S302, the CPU 201 selects a sheet usable for the maintenance processing among the sheets set in the cassettes 101*a* and 101*b*.

The priority ranking is preset to sheets usable for the maintenance processing according to the sizes and the materials of the sheets. The CPU 201 selects a sheet having a higher priority among the sheets set in the cassettes 101*a* and 101*b*.

A higher priority is assigned to a sheet having a size capable of maximally reducing a wasteful region. In other words, a higher priority is assigned to a sheet having a size closest to a half of the width of the print head 106. Further, as the priority ranking according to the material, a plain paper has a higher priority, and a glossy paper has a lower priority.

Then, in step S303, the CPU 201 determines whether there occurs an error preventing the image forming apparatus 200 from printing an image. If the CPU 201 determines that such an error has occurred (YES in step S303), the CPU 201 displays an error indication on the operation unit 206, and then the processing is ended at this time. If the CPU 201 determines that an error has not occurred (NO in step S303), the processing proceeds to step S304.

In step S304, the CPU 201 carries out the process of the cleaning A. After the process of the cleaning A is completed, the processing proceeds to step S305. In step S305, the CPU 201 carries out the first process of the maintenance A with use of partial nozzles of the print head 106. Then, the processing proceeds to step S306. Until the CPU 201 determines that the process of the maintenance A is completed for the entire width of the print head 106 (all nozzles) (NO in step S306), in step S307, the CPU 201 causes a Y movement of the print head 106 to change nozzles to be processed, repeating the process of the maintenance A. How many times the process of the maintenance A is repeated varies depending on the width of the sheet selected in step S302.

In the process of the maintenance A, the sheet conveyance speed at the time of printing the pattern for the maintenance A is different from the sheet conveyance speed at the time of reading the printed pattern by the scanner unit 107 (the latter is lower). Therefore, the CPU 201 controls the sheet conveyance speed so as to be changed between the pattern printing and the pattern reading.

At this time, the sheet conveyance speed is changed in the following manner. First, the pattern for the maintenance A is printed while the sheet is conveyed at a speed A, and the portion with the pattern printed thereon is transmitted beyond the scanner unit 107. After that, the conveyance operation is stopped.

Then, the conveyance motor is driven to rotate in the reverse direction to return the sheet to a position just before the scanner unit 107. Subsequently, the conveyance speed is switched to a speed B lower than the above-described speed when the pattern is printed, and the sheet is conveyed again so that the pattern is read by the scanner unit 107. Then, the result of the pattern reading is analyzed to determine whether there is any nozzle failing to appropriately discharge ink, and detect which nozzle is the nozzle failing to appropriately discharge ink, if any.

This detection result is stored in a non-volatile memory included in the engine control unit 208. In this way, it is possible to read the pattern for the maintenance A by the scanner unit 107 while conveying the sheet at a lower speed, thereby enabling accurate detection of a nozzle failing to appropriately discharge ink.

Further, if there is a nozzle failing to appropriately discharge ink, this nozzle is identified, and this nozzle is prohibited from discharging ink. Then, the engine control unit 208 is set in such a manner that another nozzle near the defective nozzle functions to cover the defective nozzle by discharging ink, thereby complementing the ink discharges. In step S306, if the CPU 201 determines that the process of the maintenance A is completed for the entire width of the print head 106 (YES in step S306), the processing proceeds to step S308. In step S308, the CPU 201 carries out the process of the maintenance B.

In step S308, the CPU 201 starts the process of the maintenance B for the print head 106. At this time, the CPU 201 carries out the process of the maintenance B to repeat the processes of steps S308 to S310 several times until the CPU 201 determines in step S309 that the process of the maintenance B is completed for the entire width of the print head 106 with use of the nozzles capable of discharging ink within the range of the selected sheet in a similar manner to the maintenance A.

During the process of the maintenance B, a pattern for the maintenance B (the pattern is designed for the maintenance B) is also printed, and the result thereof is also read by the scanner unit 107 in a similar manner to the maintenance A. However, during the maintenance B, after the pattern is printed, the sheet is fully dried up. Then, the pattern is read by the scanner unit 107 to determine the ink discharge state.

Therefore, after the pattern for the maintenance B is printed while the sheet is conveyed at the speed A, the portion with the pattern printed thereon is transmitted beyond the scanner unit 107. Then, the sheet keeps conveyed until the rear end of the pattern passes through the drying unit 112. After that, the conveyance of the sheet is stopped, and then the sheet is conveyed in the reverse direction at the speed B. In this way, the sheet can be fully dried up.

After that, when the leading edge of the sheet is returned to the conveyance unit 102, the conveyance of the sheet is stopped, and the sheet is conveyed again in the normal direction toward the scanner unit 107 at the speed B. Then, the pattern print result is read by the scanner unit 107, and the result thereof is transferred to the engine control unit 208.

The engine control unit 208 analyzes the acquired reading result, analyzes a variation in the ink discharge results, and controls the image processing unit 205 to generate an image correction table according to the result. The image correction table is a table indicating a pattern for making up the portion discharging a smaller ink amount with surrounding pixels to complement the ink discharges. This table is stored in the non-volatile memory of the image processing unit 205. This table is referred to when the normal print job is performed, thereby correcting image data when a normal print job is carried out.

The process of the maintenance B may be carried out in such a manner that, after the image correction table is generated, the pattern for the maintenance B is printed with the discharges of the nozzles corrected according to this table, and the processes of steps S308 to S310 are repeated to rewrite the content of the table until the print result can be in an appropriate state.

If the CPU 201 determines in step S309 that the process of the maintenance B is completed (YES in step S309), the processing of the maintenance 01 is ended, and the job of the maintenance 01 is deleted from the queue. Then, the CPU 201 clears the value of the dot count for the maintenance 01, and stores the status of the maintenance 01 in the RAM 203, indicating that the maintenance 01 has been already carried out.

Figure 4:
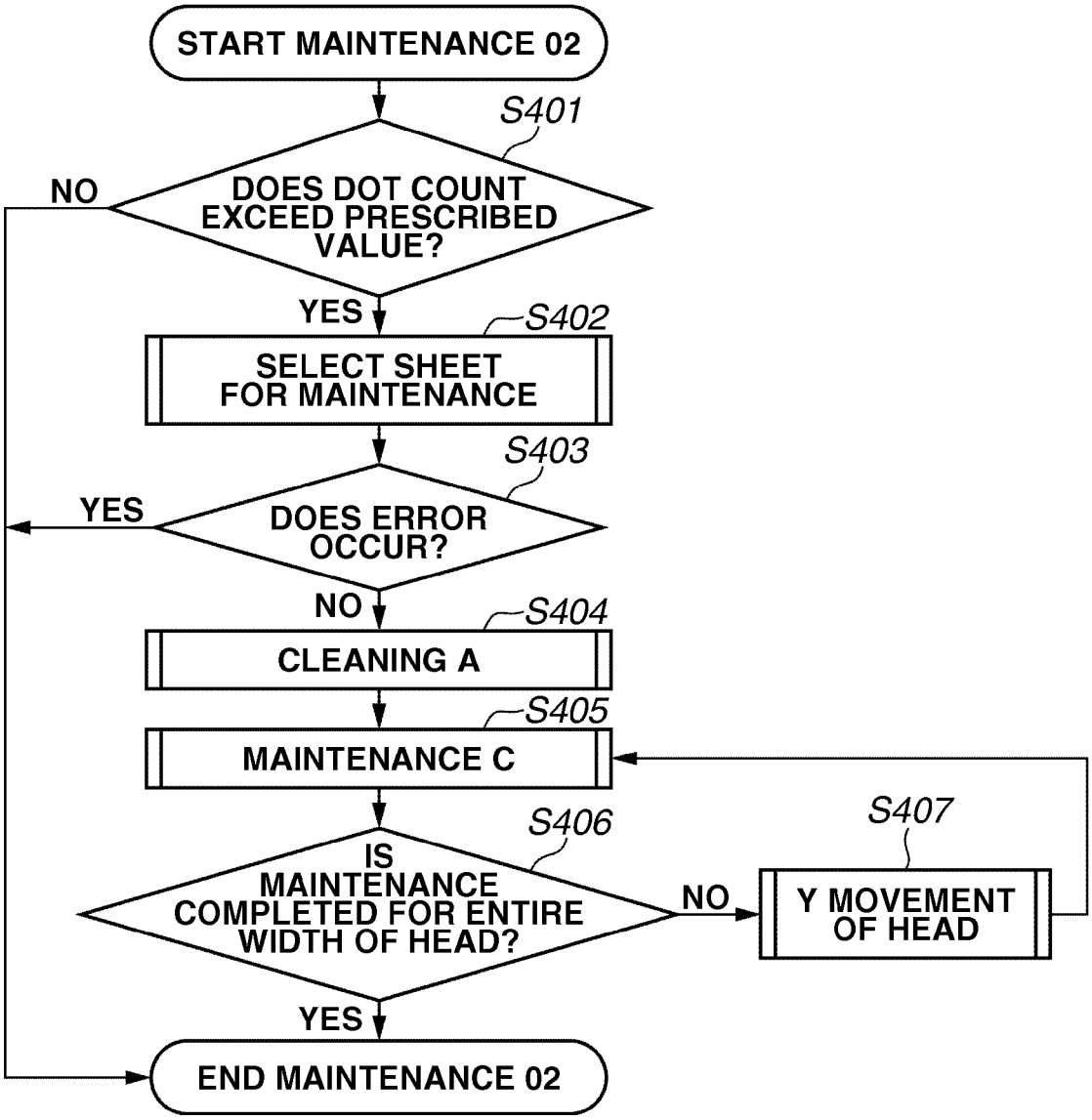
FIG. 4 is a flowchart illustrating a processing flow when maintenance 02 is carried out alone.

Next, maintenance 02, which is different maintenance processing from the maintenance 01, will be described. FIG. 4 is a flowchart illustrating a processing flow of the maintenance 02.

The maintenance 02 is also carried out when the dot count exceeds a prescribed value in a similar manner to the maintenance 01. This prescribed value is a predetermined value different from the prescribed value for the maintenance 01. The image forming apparatus 200 may be configured in such a manner that the prescribed value for the maintenance 01 and the prescribed value for the maintenance 02 can be arbitrarily set by a user.

Further, the maintenance 02 may be carried out under satisfaction of another condition different from the exceedance of the dot count over the prescribed value. During the maintenance 02, the cleaning A and maintenance C are carried out in order. The maintenance C includes printing a predetermined pattern for the maintenance C on a sheet with use of the print head 106, reading the image by the scanner unit 107, and adjusting ink amounts discharged from the respective nozzles of the print head 106. The CPU 201 also manages the maintenance 02 as a job in a similar manner to the maintenance 01, and handles it in a similar manner to a normal print job.

In step S401, the CPU 201 checks whether the dot count value for the maintenance 02 exceeds the prescribed value. If the CPU 201 determines that the dot count value for the maintenance 02 exceeds the prescribed value (YES in step S401), the CPU 201 carries out the process of the cleaning A through steps S401 to S404 in a similar manner to steps S301 to S304 illustrated in FIG. 3. After the process of the cleaning A is completed in step S404, the processing proceeds to step S405. In step S405, the CPU 201 carries out the process of the maintenance C.

During the maintenance C, the maintenance pattern (the pattern is designed for the maintenance C) is printed, and is read by the scanner unit 107, in a similar manner to the maintenance B. Further, at this time, the sheet is fully dried up by the drying unit 112, and the pattern image is read by the scanner unit 107, which are also similar processes to the maintenance B.

The maintenance C and the maintenance B are different from each other in terms of the printed pattern, the analysis process after the printed pattern is read, and the correction method based on the analysis result. The maintenance C analyzes the result of the pattern reading, and determines whether the ink discharge amount is large or small in a plurality of levels for each nozzle of the print head 106 or for each group into which the nozzles are grouped.

The engine control unit 208 is set so as to increase the ink discharge energy of a nozzle or nozzles in a group discharging a smaller amount, and conversely, reduce the ink discharge energy of a nozzle or nozzles in a group discharging a larger amount.

The engine control unit 208 stores the level of the ink discharge energy based on the analysis result in the non-volatile memory while associating it with the nozzle or the nozzles in the group, and performs printing while controlling the ink discharge energy according thereto when carrying out a normal print job.

Then, until the CPU 201 determines in step S406 that the process of the maintenance C is completed for the entire width of the print head 106 (NO in step S406), the processes of steps S407 and S408 are repeated. However, in a case where the setting of the ink discharge energy is changed, the pattern for the maintenance C may be printed based on the changed energy, and the processes of steps S405 to S407 may be repeated until the printed pattern can be in an appropriate state, thereby determining the discharge energy.

If the CPU 201 determines in step S406 that the process of the maintenance C is completed (YES in step S406), the processing of the maintenance 02 is ended, and the job of the maintenance 02 is deleted from the queue. Then, the CPU 201 clears the dot count value for the maintenance 02, and stores the state of the maintenance 02 into the RAM 203, indicating that the maintenance 02 has been already carried out.

Next, a description will be given of the processing performed when a plurality of maintenance processing jobs is registered in the queue, or a plurality of conditions for executing maintenance processing is satisfied.

In a case where another maintenance job is already registered in the queue when the condition for executing the maintenance 01 or 02 is satisfied, or in a case where both the condition for executing the maintenance 01 and the condition for executing the maintenance 02 are satisfied before they are registered in the queue, a new job is generated instead of individually separately carrying out them.

In other words, in this case, since the maintenance 01 and the maintenance 02 both redundantly include the operation of the cleaning A, maintenance 03 is registered in the queue instead of the maintenance 01 and the maintenance 02. In the maintenance 03, the cleaning A, the maintenance C, the maintenance A, and the maintenance B are carried out in order.

Figure 5:
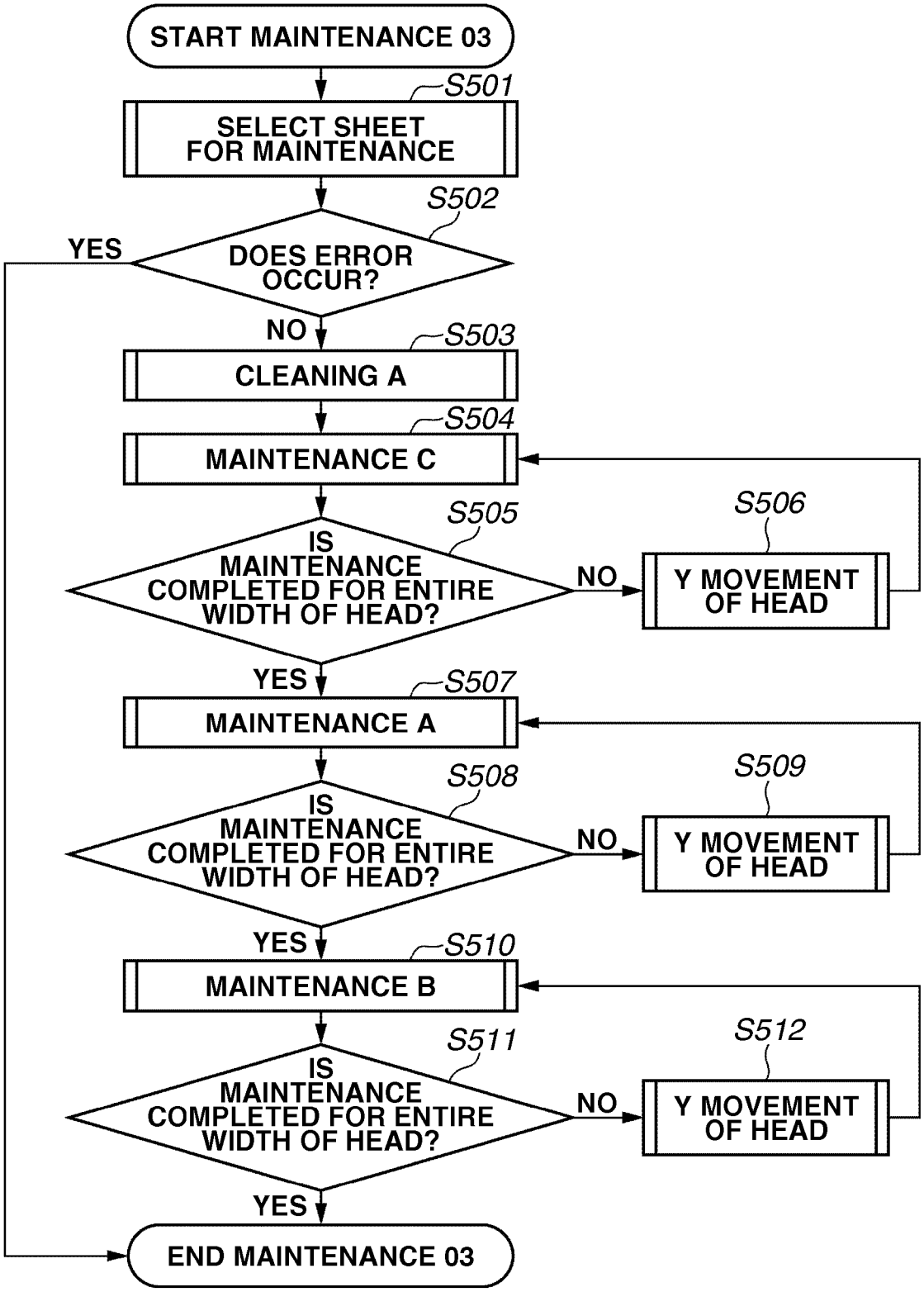
FIG. 5 is a flowchart illustrating a processing flow when maintenance 03, in which a plurality of maintenance jobs is combined, is carried out.

In a case where one or both of the maintenance 01 and the maintenance 02 are already registered in the queue as jobs but are not carried out yet, they are deleted, and the maintenance 03 is registered in the head of the queue as a job. FIG. 5 is a flowchart illustrating a processing flow of the maintenance 03.

At the timing when the CPU 201 checks the dot count values for the maintenance 01 and the maintenance 02, if both dot count values exceed the prescribed values, the CPU 201 registers a job of the maintenance 03 in the queue. Then, the flowchart illustrated in FIG. 5 is started.

Further, the flowchart illustrated in FIG. 5 is also performed in the following case. If the dot count value for the maintenance 02 exceeds the prescribed value when a job of the maintenance 01 is registered in the queue but is not yet carried out, or vice versa, such a case also triggers the flowchart illustrated in FIG. 5. In this case, the job of the maintenance processing already registered in the queue is deleted from the queue, and a job of the maintenance 03 is newly registered in the queue.

In FIG. 5, the processes of the respective steps are similar to those illustrated in FIGS. 3 and 4, and therefore the descriptions thereof will be omitted here. After completion of the processing of the maintenance 03, the CPU 201 clears the dot count values for the maintenance 01 and the maintenance 02, and stores the states of the maintenance 01 and the maintenance 02 in the RAM 203, indicating that they have been already carried out.

Figure 6:
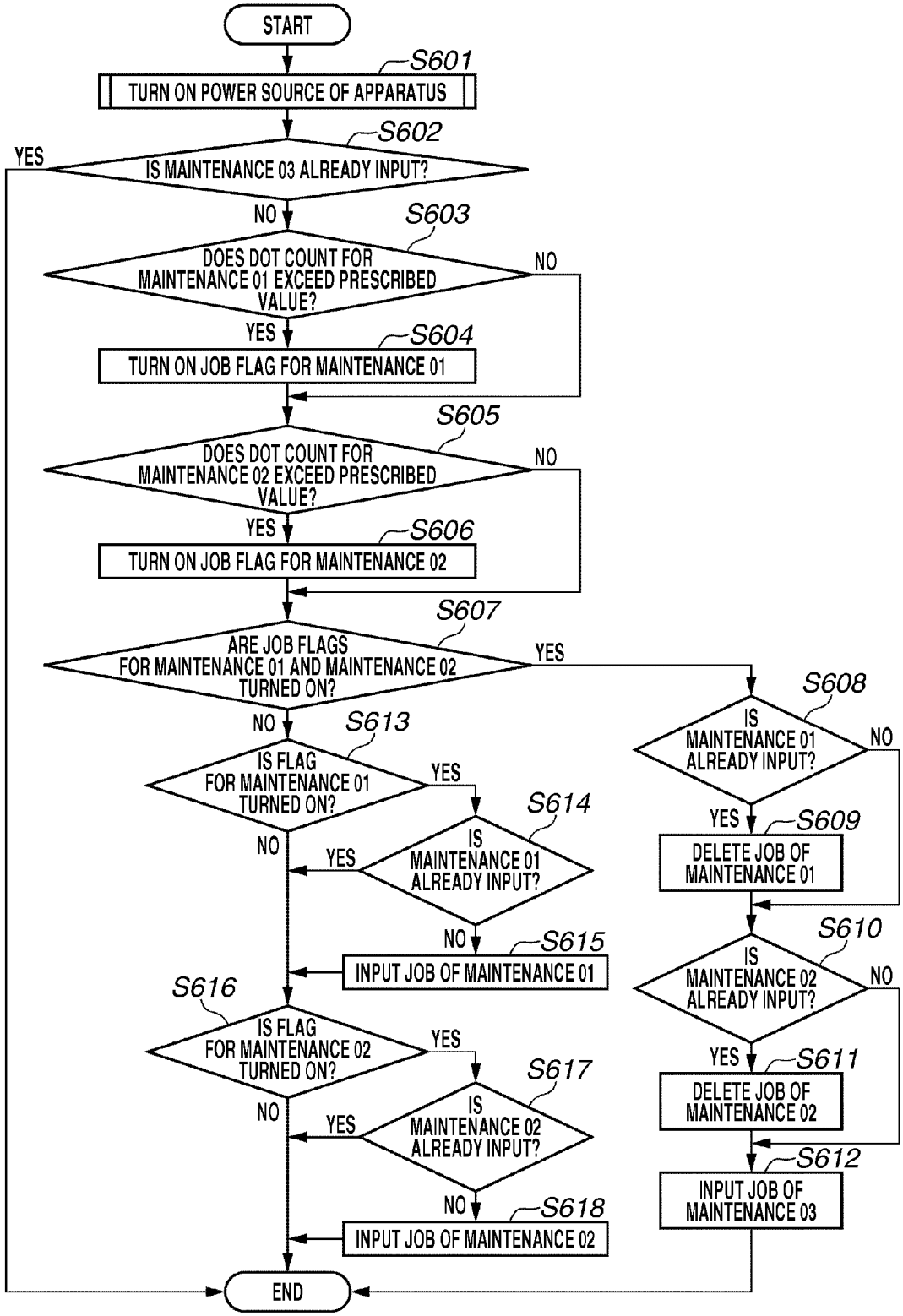
FIG. 6 is a flowchart illustrating a processing flow of maintenance jobs.

Next, a description will be given of the processing performed when the maintenance 01, the maintenance 02, and the maintenance 03 are registered in the queue as jobs. FIG. 6 is a flowchart illustrating this processing flow.

In step S601, the image forming apparatus 200 is powered on. Then, the CPU 201 initializes the respective units, and checks whether any job input into the image forming apparatus 200 but unexecuted yet is stored in the HDD 204.

For example, in a case where the image forming apparatus 200 is configured in such a manner that a power source can be provided separately to the image processing unit 207, a job can be received by the image processing unit 207 to be stored in the HDD 204 or to allow its image processing to be partially advanced even when the image forming apparatus 200 is powered off.

Therefore, since there is a possibility that an unexecuted job may be left in the HDD 204, the CPU 201 checks that. Further, besides a job that may be input when the image forming apparatus 200 is powered off, there is a possibility that the image forming apparatus 200 may receive a job while being powered on, but the image forming apparatus 200 may be powered off without carrying out this job. Therefore, the CPU 201 also checks such a job.

In step S602, the CPU 201 checks whether a job of the maintenance 03 is already input (registered in the queue). If the CPU 201 determines that a job of the maintenance 03 is already registered in the queue (YES in step S602), this job of the maintenance 03 is placed at the head of the queue. The processing flow illustrated in FIG. 6 is ended at this time, and the processing of the maintenance 03 is carried out as illustrated in FIG. 5. If the CPU 201 determines that a job of the maintenance 03 is not registered in the queue yet (NO in step S602), the processing proceeds to step S603.

In step S603, the CPU 201 determines whether the dot count value for the maintenance 01 exceeds the prescribed value for the maintenance 01. If the CPU 201 determines that the dot count value for the maintenance 01 exceeds the prescribed value for the maintenance 01 (YES in step S603), the processing proceeds to step S604. In step S604, the CPU 201 turns on a job flag for the maintenance 01. This job flag is a flag indicating that the image forming apparatus 200 is in a state involving execution of the maintenance 01.

Subsequently, in step S605, the CPU 201 determines whether the dot count value for the maintenance 02 exceeds the prescribed value for the maintenance 02. If the CPU 201 determines that the dot count value for the maintenance 02 exceeds the prescribed value for the maintenance 02 (YES in step S605), the processing proceeds to step S606. In step S606, the CPU 201 turns on a job flag for the maintenance 02.

Subsequently, in step S607, the CPU 201 determines whether both the job flag for the maintenance 01 and the job flag for the maintenance 02 are turned on. If the CPU 201 determines that both the job flags are turned on (YES in step S608), the processing proceeds to step S608. If the CPU 201 determines that any one of the job flags is turned off (NO in step S607), the processing proceeds to step S613.

In step S608, the CPU 201 determines whether a job of the maintenance 01 is already registered in the queue. If the CPU 201 determines that a job of the maintenance 01 is already registered in the queue (YES in step S608), in step S609, the CPU 201 deletes the job of the maintenance 01 from the queue. Then, the processing proceeds to step S610.

In step S610, the CPU 201 determines whether a job of the maintenance 02 is already registered in the queue. If the CPU 201 determines that a job of the maintenance 02 is already registered in the queue (YES in step S610), in step S611, the CPU 201 deletes the job of the maintenance 02 from the queue. Then, the processing proceeds to step S612.

In step S612, as described above, the CPU 201 generates a job of the maintenance 03 by combining the maintenance 01 and the maintenance 02, and omitting one of redundantly included maintenance operations (the cleaning A) to register this job at the head of the queue. In other words, the CPU 201 generates a job of the maintenance 03, in which is combined the maintenance 01 with the maintenance 02 and only one operation of the cleaning A is included, to register this job at the head of the queue. Then, the processing flow illustrated in FIG. 6 is ended at this time, and the processing of the maintenance 03 is carried out as illustrated in FIG. 5.

In step S613, the CPU 201 determines whether the job flag for the maintenance 01 is turned on. If this job flag is turned on (YES in step S613), the processing proceeds to step S614. In step S614, the CPU 201 determines whether a job of the maintenance 01 is already registered in the queue. If the CPU 201 determines in step S614 that a job of the maintenance 01 is not registered (NO in step S614), in step S615, the CPU 201 registers a job of the maintenance 01 at the head of the queue since maintenance processing that should be carried out at this time is only the maintenance 01.

If the CPU 201 determines in step S613 that the job flag for the maintenance 01 is not turned on (NO in step S613), the processing directly proceeds to step S616 since the image forming apparatus 200 is not in such a state that maintenance 01 should be carried out. If the CPU 201 determines in step S614 that a job of the maintenance 01 is already registered in the queue, or if a job of the maintenance 01 is registered in the queue in step S615, the CPU 201 carries out the processing of the maintenance 01 illustrated in FIG. 3, prioritizing it over another print job.

In step S616, the CPU 201 determines whether the job flag for the maintenance 02 is turned on. If this job flag is turned on (YES in step S616), the processing proceeds to step S617. In step S617, the CPU 201 determines whether a job of the maintenance 02 is already registered in the queue. If the CPU 201 determines in step S617 that a job of the maintenance 02 is not registered in the queue (NO in step S617), the CPU 201 registers a job of the maintenance 02 at the head of the queue in step S618, since maintenance processing that should be carried out at this time is only the maintenance 02.

If the CPU 201 determines in step S616 that the job flag for the maintenance 02 is not turned on (NO in step S616), the processing flow illustrated in FIG. 6 is ended at this time since the image forming apparatus 200 is not in such a state that the maintenance 02 should be carried out, and is not in such a state any of the maintenance 01 and the maintenance 02 should be carried out. If the CPU 201 determines in step S617 that a job of the maintenance 02 is already registered in the queue, or if a job of the maintenance 02 is registered in the queue in step S618, the CPU 201 carries out the processing of the maintenance 02 illustrated in FIG. 4, prioritizing it over another print job.

In this way, even when a condition triggering maintenance is satisfied, if a job of the same maintenance processing is already input, a job of this maintenance processing is prevented from being redundantly input, thereby preventing the same maintenance processing from being carried out twice or more in a short time.

Further, even when different types of maintenance processing are input, a common operation is prevented from being redundantly carried out, thereby preventing the same operation from being carried out twice or more in a short time. As a result, it is possible to prevent wasteful use of ink and a sheet, and reduce a waiting time of a normal print job.

In the flow of FIG. 6, when the image forming apparatus 200 is powered on, the CPU 201 checks existence of an unexecuted job. However, even at any other time than the time when the image forming apparatus 200 is powered on, the CPU 201 sequentially monitors a newly input job, and performs step S602 and the steps thereafter.

Further, in the above description, two types of maintenance processing are employed as maintenance processing. However, another maintenance processing may be employed. In any case, the present exemplary embodiment prevents a common process from being redundantly carried out, thereby improving efficiency. Further, in the description above, the maintenance processing of the print head is described as an example, the maintenance processing is not limited thereto. For example, it may be maintenance processing of tanks of the image forming apparatus 200.

Further, the present exemplary embodiment has been described based on an example in which the condition for executing the maintenance processing is exceedance of the dot count value over the prescribed value. However, for example, another condition may be combined. Examples of other conditions include a condition that a predetermined time has elapsed, a condition that a waiting time has reached a predetermined time, a condition that a predetermined number of pages are printed, a condition that the image forming apparatus 200 is started up, a condition that sheets are replaced, and a condition that ink is replaced.

Further, as the dot count value, there are various types of conditions such as a total dot number for all ink colors and a dot number for each ink color, any of which may be employed. Further, the present exemplary embodiment is not limited to the maintenance processing to be automatically carried out. In the present exemplary embodiment, the maintenance processing may be carried out in response to a user' instruction input via the operation unit 206.

Further, in the above description, the CPU 201 determines whether the condition is satisfied by determining whether the dot count value exceeds the threshold value. However, for example, the CPU 201 may determine that the condition is satisfied if there is a dot count close to the threshold value even though the dot count does not reach the threshold value.

In the above description, the present exemplary embodiment has been described based on an example in which the maintenance 01 and the maintenance 02 are carried out by generating the maintenance 03 from a combination of the maintenance 01 and the maintenance 02, and carrying out the maintenance 03. However, the present exemplary embodiment is not limited thereto.

For example, the maintenance 01 and the maintenance 02 may be individually carried out, after, among maintenance operations redundantly included in the maintenance 01 and the maintenance 02, a maintenance operation in any one of the maintenance 01 and the maintenance 02 is omitted.

Further, in the above description, the maintenance processing is handled as a job. However, the maintenance processing does not necessarily have to be handled as a job. Even in this case, the present exemplary embodiment may be realized by omitting at least one of redundant maintenance operations or preventing the same operation from being successively carried out, thereby acquiring the same advantageous effect.

Further, in the above description, the present exemplary embodiment has been described based on an example in which redundant operations are shortened by just omitting one of the redundant operations. However, the present exemplary embodiment is not limited thereto. For example, redundant operations may be shortened by simplifying one or both of the redundant maintenance operations.

More specifically, for example, the maintenance operation may be carried out while taking a time longer than the time normally used to carry out the maintenance operation once by a predetermined time, but shorter than the time used to carry out the maintenance operation twice.

Further, in the above description, whether the condition for executing the maintenance 02 is satisfied is determined before completion of the maintenance 01. However, the present exemplary embodiment is not limited thereto.

For example, in a case where only a short time has elapsed after completion of one of the maintenance 01 and the maintenance 02, the redundant maintenance operations in the maintenance 01 and the maintenance 02 may be shortened. This "short time" can be, for example, selected by a user, or set in advance in a storage device such as the HDD 204.

In the above description, the present exemplary embodiment has been described based on an example in which there are two types of maintenance processing. When there are three or more types of maintenance processing, the present exemplary embodiment can be also realized in a similar manner by carrying out the respective types of maintenance processing after redundant maintenance operations are shortened, or combining the respective types of maintenance processing to generate and carry out new maintenance processing after the redundant maintenance operations are shortened.

In the above-described exemplary embodiment, processing such as scheduling of an input of a maintenance job, except for the print processing, may be performed by an external apparatus such as the host apparatus 211 or an externally attached controller, and the image forming apparatus 200 may carry out the job according thereto. In this case, the host apparatus and the external apparatus function as the print control apparatus. In this case, the external apparatus acquires the status from the image forming apparatus 200, and determines the order of jobs and how to combine them.

Figure 7:
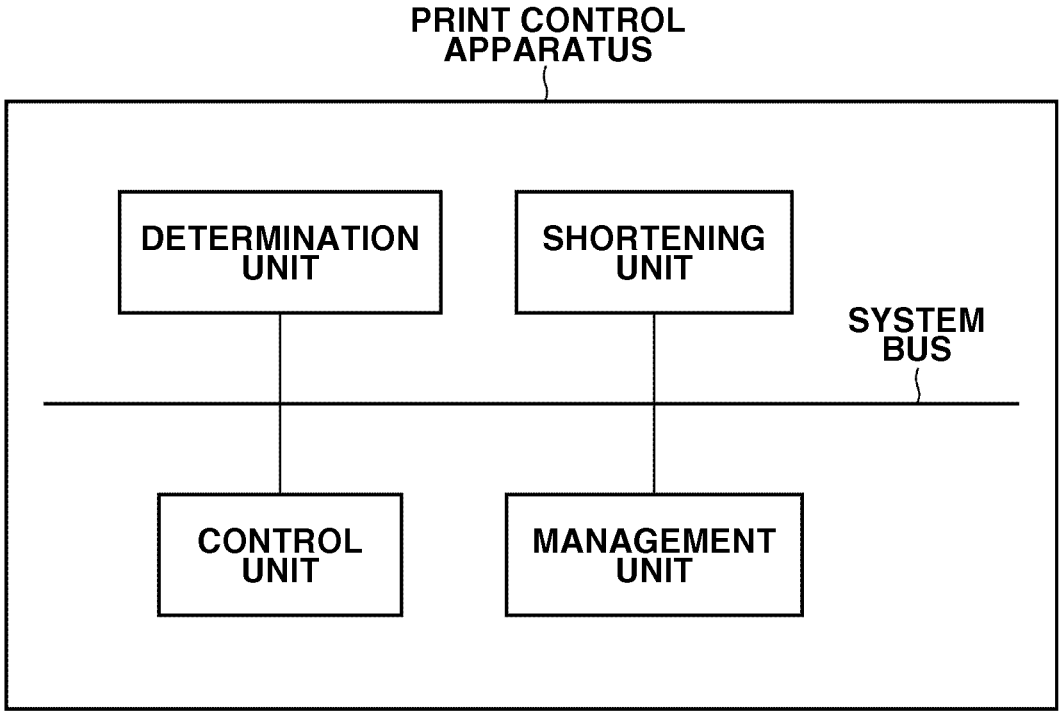
FIG. 7 is a block diagram illustrating a configuration relating to a print control apparatus.

As previously described, the functional blocks illustrated in FIG. 2 may be configured in various manners, different from the distribution of the respective blocks illustrated in FIG. 2, by appropriately dividing the blocks into individual processing units or control units, or integrating several blocks. For example, the functional blocks of FIG. 2 may be configured as a print control apparatus configured to cause a printing unit to perform print processing, where the print control apparatus may include a determination unit configured to determine whether a condition for executing maintenance processing of the printing unit such as print heads 106 is satisfied, a shortening unit configured to shorten redundant maintenance operations in first maintenance processing and second maintenance processing in a case where the determination unit determines that a condition for executing the second maintenance processing is satisfied before completion of the first maintenance processing, and a control unit configured to cause the first maintenance processing and the second maintenance processing to be carried out after the shortening unit shortens the redundant maintenance operations (see FIG. 7). The print control apparatus may include a management unit configured to manage a job by a queue, wherein the management unit manages each maintenance processing by the queue as a job. Further, in the present exemplary embodiment, the CPU 201 executes a program to implement the processing in FIGS. 3 to 6. However it is not limited thereto. For example, the CPU 201 does not need to execute entire processing, and each of the units illustrated in FIG. 7 may be realized by hardware such as an ASIC. In addition, part of the units may be realized by hardware, and part of the units may be realized by software.

Further, the present exemplary embodiment can be also implemented by performing the following processing, i.e., processing for providing a system or an apparatus with software (program) capable of realizing the functions of the above-described exemplary embodiment via a network or various kinds of storage media (e.g. a non-transitory computer-readable recording medium), and causing a computer (or, for example, a CPU an MPU, and/or the like) of the system or the apparatus to read out and execute the program.

Further, the program may be executed by a single computer or a plurality of computers in cooperation. Further, the above-described processing does not necessarily have to be entirely realized by means of software. A part or all of the processing may be realized by means of hardware.

Further, the claimed invention is not limited to the above-described exemplary embodiment. Various modifications and variations (including, for example, application to another exemplary embodiment and a combination with another exemplary embodiment) can be made without departing from the spirit of the claimed invention.

While the claimed invention has been described with reference to exemplary embodiments, it is to be understood that the claimed invention is not limited to the disclosed exemplary embodiments. The scope of the following claims is to be accorded the broadest interpretation so as to encompass all modifications, equivalent structures, and functions.

This application claims priority from Japanese Patent Application No. 2011-232047 filed Oct. 21, 2011, which is hereby incorporated by reference herein in its entirety.

What is claimed is:

1. A print control apparatus configured to cause a printing unit to perform print processing, the print control apparatus comprising:

a determination unit configured to determine whether a condition for executing maintenance processing of the printing unit is satisfied;

a shortening unit configured to shorten redundant maintenance operations in a first maintenance processing and a second maintenance processing in a case where the determination unit determines that a condition for executing the second maintenance processing is satisfied before completion of the first maintenance processing; and a control unit configured to cause the first maintenance processing and the second maintenance processing to be carried out after the shortening unit shortens the redundant maintenance operations.

2. The print control apparatus according to claim 1, wherein the shortening unit shortens the redundant maintenance operations by omitting one of the redundant maintenance operations in the first maintenance processing and the second maintenance processing.

3. The print control apparatus according to claim 1, wherein the control unit causes the first maintenance processing and the second maintenance processing to be carried out by causing third maintenance processing to be carried out, the third maintenance processing being a combination of the first maintenance processing and the second maintenance processing.

4. The print control apparatus according to claim 1, further comprising a management unit configured to manage a job by a queue, wherein the management unit manages each maintenance processing by the queue as a job.

5. The print control apparatus according to claim 4, wherein the determination unit determines whether the condition for executing the second maintenance processing is satisfied in a case where the first maintenance processing is managed as a job in the queue managed by the management unit.

6. The print control apparatus according to claim 4, wherein the determination unit determines whether a condition for executing the first maintenance processing and the condition for executing the second maintenance processing are satisfied, before a job of the first maintenance processing and a job of the second maintenance processing are registered in the queue managed by the management unit.

7. The print control apparatus according to claim 4, wherein, in a case where at least one of a job of the first maintenance processing and a job of the second maintenance processing are registered in the queue, the control unit deletes the at least one maintenance processing job from the queue, and registers a job of third maintenance processing in the queue, the third maintenance processing being a combination of the first maintenance processing and the second maintenance processing.

8. The print control apparatus according to claim 4, wherein, in a case where a print job and a job for maintenance processing are registered in the queue, the control unit changes an order of the jobs in the queue in such a manner that the maintenance processing is carried out before the print job that is registered in the queue but is not yet started.

9. The print control apparatus according to claim 1, wherein the condition for executing the maintenance processing includes a dot count value, an elapse of a predetermined time, a number of printed sheets, a number of printed pages, a startup of the apparatus, a replacement of a recording material, or a replacement of a recording agent.

10. The print control apparatus according to claim 1, wherein the printing unit performs inkjet print processing.

11. The print control apparatus according to claim 10, wherein the maintenance processing includes at least one maintenance operation of a process for sucking ink from an ink discharge portion, a process for wiping an ink discharge surface, a process for correcting a nozzle incapable of appropriately discharging ink, a process for correcting uneven ink discharge states, a process for correcting an ink discharge amount, and a preliminary discharge process.

12. A print control method for a print control apparatus configured to cause a printing unit to perform print processing, the print control method comprising:

determining whether a condition for executing maintenance processing of the printing unit is satisfied;

shortening redundant maintenance operations in a first maintenance processing and a second maintenance processing in a case where the maintenance processing is determined that a condition for executing the second maintenance processing is satisfied before completion of the first maintenance processing; and causing the first maintenance processing and the second maintenance processing to be carried out after the redundant maintenance operations are shortened by the shortening.

13. The print control method according to claim 12, wherein the redundant maintenance operation are shortened by omitting one of the redundant maintenance operations in the first maintenance processing and the second maintenance processing.

14. The print control method according to claim 12, wherein the first maintenance processing and the second maintenance processing is caused to be carried out by causing third maintenance processing to be carried out, the third maintenance processing being a combination of the first maintenance processing and the second maintenance processing.

15. The print control method according to claim 12, further comprising managing a job by a queue, wherein each maintenance processing is managed by the queue as a job.

16. The print control method according to claim 15, wherein the maintenance processing is determined whether the condition for executing the second maintenance processing is satisfied in a case where the first maintenance processing is managed as a job in the queue.

17. The print control method according to claim 15, wherein the maintenance processing is determined whether a condition for executing the first maintenance processing and the condition for executing the second maintenance processing are satisfied, before a job of the first maintenance processing and a job of the second maintenance processing are registered in the queue.

18. The print control method according to claim 15, wherein, in a case where at least one of a job of the first maintenance processing and a job of the second maintenance processing are registered in the queue, the at least one maintenance processing job is deleted from the queue, and a job of third maintenance processing is registered in the queue, the third maintenance processing being a combination of the first maintenance processing and the second maintenance processing.

19. The print control method according to claim 15, wherein, in a case where a print job and a job for maintenance processing are registered in the queue, an order of the jobs in the queue is changed in such a manner that the maintenance processing is carried out before the print job that is registered in the queue but is not yet started.

20. A non-transitory computer-readable recording medium storing a program for causing a computer to execute the print control method according to claim 12.

* * * * *